US006139449A

United States Patent [19]

Cardarelli

[11] Patent Number: 6,139,449

[45] Date of Patent: Oct. 31, 2000

[54] GOLF TEE

[76] Inventor: Venanzio Cardarelli, 20 N. Triangle Dr., Plymouth, Mass. 02360

[21] Appl. No.: 09/235,607

[22] Filed: Jan. 20, 1999

Related U.S. Application Data

[60] Provisional application No. 60/072,686, Jan. 27, 1998.

[51] Int. Cl.[7] ..... A63B 57/00

[52] U.S. Cl. ..... 473/387

[58] Field of Search ..... 473/387–403, 473/577, 578, 581, 582; D21/717, 718

[56] References Cited

U.S. PATENT DOCUMENTS

| | | | |
|---|---|---|---|
| D. 326,129 | 5/1992 | Hirschmann . | |
| D. 348,296 | 6/1994 | Salonica | D21/718 |
| D. 365,169 | 12/1995 | Fillipp | D21/718 |
| D. 411,276 | 6/1999 | Rosenfeld | D21/718 |
| 2,153,260 | 4/1939 | Mayl | 473/389 |
| 2,455,705 | 12/1948 | Seager | 473/402 |
| 3,782,723 | 1/1974 | Morris . | |
| 3,947,827 | 3/1976 | Brown . | |
| 4,380,340 | 4/1983 | Simo | 473/577 |
| 4,783,077 | 11/1988 | Lemon | 473/402 |
| 5,193,803 | 3/1993 | Fleck III . | |
| 6,010,413 | 1/2000 | Pan-Chung | 473/402 |

*Primary Examiner*—Steven Wong
*Attorney, Agent, or Firm*—D. Michael Burns

[57] ABSTRACT

A golf tee having a central stem supporting three fan shaped flutes which extend vertically upwards and have extremities of point shaped vertices for holding a golf ball. The vertices having minimum contact area with the ball in order to avoid unnecessary frictional interference between ball and tee. The vertices are located high above the central stem creating an open area under the ball whereby air can flow through without prematurely imparting any motion to the ball. The flutes have notched edges to enable the golfer to be able to feel how deep the tee is being inserted into the ground.

11 Claims, 1 Drawing Sheet

GOLF TEE

CROSS REFERENCE TO RELATED APPLICATION

This application is based on Provisional Patent Application Ser. No. 60/072,686, filed Jan. 27, 1998.

BACKGROUND OF THE INVENTION

1. Field of the Invention

The present invention relates to a golf tee, and more specifically pertains to a new and improved golf tee, one that is extremely stable when inserted into the ground and also allows a golf ball to be driven off the tee with a minimum of interference between the golf tee and the golf ball.

2. Description of the Prior Art

Golf tees have been available in numerous designs, shapes and sizes. It is well known that in hitting a golf ball the most important considerations for all golfers, regardless of skill level, are consistency and reproducibility. Every golfer strives to achieve his personal best through adopting the same stance, same grip, same backswing, same body turn and the same follow-through each and every time he hits the ball with a full swing. The flight of the golf ball is dependent on certain factors such as the height in which the ball is teed up off the ground, back spin imparted to the ball, wind conditions and dimple construction on the ball itself. Tees are often overlooked and most golfers are not aware of the importance the tee plays in obtaining a consistently good golf game. Most tees are conventionally made of solid wood and most have a circular shaped cup supported by an elongated circular stem. This circular stem can be a major cause of instability. The narrow circular configuration is subject to easy movement, especially from the approaching wind gust created by an advancing golf club head. Some of the newer golf club heads are twice the size of golf heads of just twenty years ago. Any movement of the golf tee can alter the contact between club face and ball. The slight concavity of the standard tee allows for too much surface contact between tee and ball. The movement of the ball across the concave surface will prematurely impart a spin to the ball, and quite often it will be an undesirable spin. This spin will be accelerated by the natural wind conditions of the day. One known feature of golf ball flight is that the initial spin will determine the initial flight pattern. It is therefore desirable for the ball to have limited contact with the tee. The club face angle, dimples on the ball, wind conditions and the golf swing should be the only determinants on the flight of the golf ball. It is therefore another important feature of the tee, that there be minimum contact surface area between ball and tee.

The height that the ball is teed-up from the ground is very important in determining flight characteristics. Although position of the stance has some bearing, generally the lower the ball is to the ground, the more likely the shot will have overspin and a lower trajectory. Often this is desired. Usually it is a matter of personal preference as to the ball height, but what is critical is that the ball be at the same height for each of the same type shot by the same person. Thus, the tee when inserted into the ground, should remain exactly at that position. A gust of air, poor soil conditions or the air mass preceding the club face must not be allowed to inadvertently dislodge the ball from the tee. Although the swing speeds of golfers will vary with strength and skill, even the beginner is capable of attaining sufficient velocity to prematurely dislodge the ball.

The U.S. Pat. No. 4,783,077 issued to Lemon on Nov. 8, 1988, describes a golf tee that teaches the importance of using a plurality of flutes for stability and minimal contact area between tee and ball. Lemon stresses the importance that the tee should not significantly interfere with the flight of the ball. Lemon also shows that the contact points should be at a height higher than the highest point of the central support pedestal. He does not address the need wherein the flutes should have a fan-like design which would enable the air currents to aerodynamically slide by the tee; as does the present invention. Lemon also does not teach the importance of an open area beneath the points of contact to insure that the gusts of air created by the approaching club face will not prematurely set the ball in motion.

The U.S. Pat. No. 5,193,803 to Fleck III issued on Mar. 16, 1993 teaches the need for the golf ball to be struck by the club without any interference from the surface. Fleck III achieves this by the use of a stanchion to supportively engage a ground surface and a cantilevered support for the ball. Fleck III does not teach any means of stabilzation to protect against any inadvertent movement and his three points of contact are not minimal.

Morris teaches a non-interferring golf tee in U.S. Pat. No. 3,782,723 issued on Jan. 1, 1974. This patent addresses the need to avoid any obstruction to the trajectory of the ball driven off the tee. Whereas Morris does offer some help to eliminate any such interference, he does not teach a way to offset the problem created by the wind rush of the advancing club head nor does he, as does the present invention, teach a solution for the basic instability of the circular tee stem.

U.S. Pat. No. 3,947,827 issued to Brown on Mar. 30, 1976, discloses a golf tee that allows for motion to be imparted to the ball before the club contacts the ball surface. An initial backspin on the ball supposably will improve its flight characteristics. While Brown suggests that there are advantages to imparting a spin to the ball prior to the striking of it, the present invention seeks to eliminate unnecessary and improper spin. The present invention, with a three prong support will eliminate the drag of the ball that is caused when the ball has to slide across the tee.

Hirschmann, in a U.S. Design Patent No. D 326,129 issued on May 12, 1992 shows a golf tee that utilizes flutes/flanges for creating stability in inserting the tee. This tee will offer a measure of stability as it is inserted into the ground but does not allow for the wind gusts to pass through and under the tee as does the present invention.

None of the above inventions and patents, either singly or in combination, is seen to describe the instant invention as claimed.

SUMMARY OF THE INVENTION

One of the major desires for a golfer is to develop a consistent striking of the golf ball. Every golfer is aware of the importance of the following fundamentals: proper grip and stance; keeping the head still; cocking the wrists and maintaining this position until the very last moment prior to contact; keeping the left arm straight (for right-handed golfers); flexing the knees; hand pressure, firm but not too tight; guarding against "coming over the top" which will cause a hook; or that the swing be "left open" thereby causing a slice. Golfers spend numerous hours on the practice tee hitting thousands of golf balls to create "muscle memory" in their golf swing, which they hope will carry over to the golf course. At golf driving ranges the tee is usually at a preset height, but not all are necessarily at the same height. It is self-defeating to practice using the tee at one height, only to use another height on the golf course. This will only mean imparting unwanted backspin or maybe putting too much topspin, which will make it difficult for the ball to achieve proper trajectory.

The tee of the present invention will have minimal points of contact with the ball. This will insure no undesirable spin since, there is virtually no surface area in which the ball will have to slide across. This allows the golf club to determine the spin, not the tee. After striking the ball, wind currents and dimple arrangements of the ball will significant effect the flight trajectory. The shaft of the tee has a plurality of fan-shaped flutes, so that besides making it easy to insert into the ground, there is little likelihood of any movement caused by wind gusts. The contact points or vertices are above the highest point of the central support, with a large open area between them. This will allow the air gusts, created by the advancing club face, to slide around and under the ball.

The tee of the present invention will have a plurality of notches in the fluted sections, to make it easy for the golfer to know by feel how deep he is inserting the tee into the ground.

Accordingly, it is a principal object of the present invention to provide an improved golf tee which comprises an elongated shaft, which is supported by a plurality of fan shaped flutes that help the tee resist any unwanted movement while holding the golf ball.

It is another object of the present invention to provide an improved golf tee which includes a plurality of vertices which allow the golf ball to be struck and propelled without any premature spin being imparted during the initial takeoff.

It is a further object of the invention to provide an improved golf tee which includes an air space beneath the ball which in turn allows for any air gusts generating ahead of the golf club to bypass without disturbing the ball. The fan shaped flutes will also assist this effort.

Still another object of the invention is to provide an improved golf tee which is a one piece, inexpensive and easy to make while adding distance for every golfer using it, regardless of ability.

These and other objects of the present invention will become readily apparent upon further review of the following specifications and drawings.

Similar reference characteristics denote corresponding features consistently throughout the attached drawings.

DETAILED DESCRIPTION OF THE PREFERRED EMBODIMENT

Figure 1:
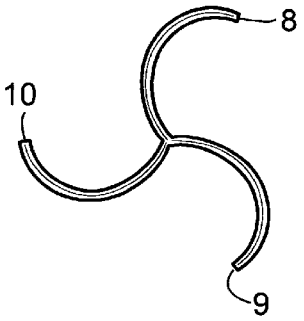
FIG. 1 is a top view of the golf tee, showing the special relationships of the vertices.
Figure 2:
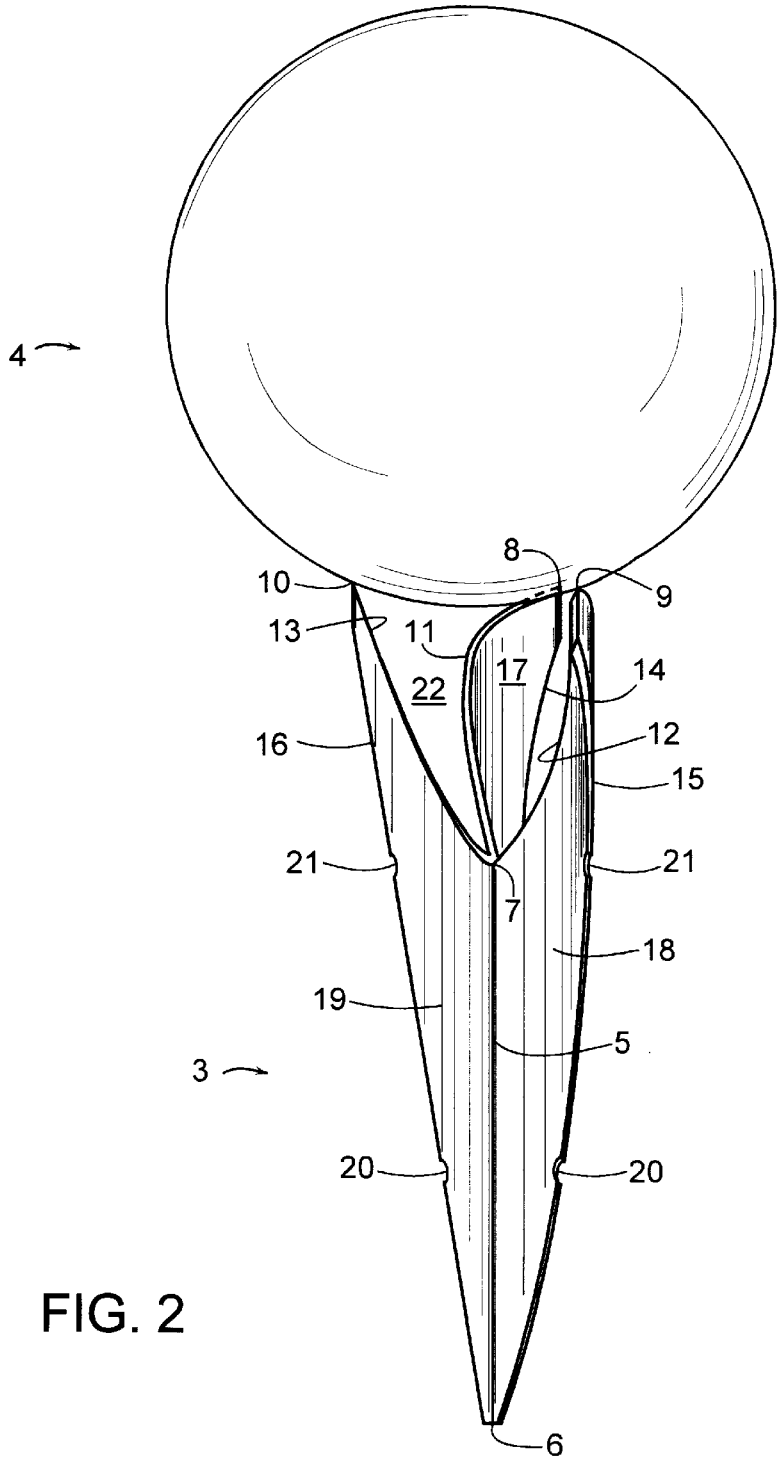
FIG. 2 is an environmental perspective view of the tee holding a golf ball.

The present invention relates to a golf tee with its top view shown in FIG. 1 and with an environmental perspective view shown by FIG. 2. The golf tee 3 is of one piece and supports a golf ball 4. The tee 3 has an elongated central support stem 5 that has a pointed base section 6, which is used to insert the tee 3 into the ground. The support stem 5 has an upper end 7 which functions as a support for a plurality of fan shaped projections 11, 12 and 13 which terminate in upper vertices 8, 9 and 10 respectively. Vertices 8, 9 and 10 are radially equidistant from the central support stem 5 and serve to support the golf ball 4 with absolute minimum contact. The fan shaped flutes 17, 18 and 19 are angularly spaced equally with respect to the central axis of the support stem 5. The flutes 17, 18 and 19 are essentially identical in size and shape and are formed by the projection of the edges 14, 15 and 16, all of which extend from the stem base 6 and terminate in the upper vertices 8, 9 and 10 respectively. The dimensions of the vertices 8, 9 and 10 may be exaggerated in the drawings for illustration purposes. It will be appreciated that the vertices 8, 9 and 10 are longitudinally positioned and substantially elevated with respect to the upper end 7 of the support stem 5. The vertices 8, 9 and 10 are spaced so that a golf ball 4 may be supported in a stable, elevated position, such as in the three point contact relationship as illustrated in FIG. 2. It should also be appreciated that the contact dimensions of the three vertices 8, 9 and 10 are quite unsubstantial and may be regarded as essentially point-like.

The curved, fin-like flute design allows for greater stability when flutes 17, 18 and 19 are inserted into the ground. The tee 3 has greater resistance to momentum from wind forces, and is more stable in soft or sandy soil conditions. The curved shape will also resist movement when the advancing club head approaches the ball 4. The air gust that precedes the club face has been known to dislodge a ball from a tee surface, creating undesirable ball position. The curved flute design allows this air gust to slide by the tee 3. In addition the vertices 8, 9 and 10 are positioned above the upper stem 7, forming an opening 22, which will allow for air to pass under and without any disturbance to the ball 4.

The projection edges 14, 15 and 16 each have a lower notch 20 and an upper notch 21 defined in their edges. There could be more of these notches but only two are shown for illustrative purposes. These notches 20 and 21 allow the golfer to quickly ascertain, by feel, how far he/she wants to insert the tee 3 into the ground. Although the height level is a matter of personal choice, it is important that the choice be consistent. It is well known that golfers can change the desired amount of topspin or backspin by adjusting the level of the tee.

While the materials of construction of the golf tee 3 would not be a factor in the design or functioning of the tee 3, it is anticipated that the materials be an extruded, one-piece plastic molding. Standard wood material would work equally as well as plastic, however it would not seem to be as cost efficient.

It is to be understood that the present invention is not to be regarded as being limited to the embodiment described above, but encompasses any and all embodiments within the scope of the following claims.

I claim:

1. A golf tee comprising:

an elongate central support stem having a longitudinal axis, an upper end and a lower end, a pointed base section integral with the lower end for inserting the tee into the ground;

three fan shaped projections angularly spaced in respect to and extending upwardly from the upper end of the stem, terminating in three respective vertices, the vertices radially equidistant and substantially elevated in relation to the stem, the vertices spaced so that a golf ball may be in a supportedly elevated position with absolute minimum point like contact, such that premature spin will not be imparted to the ball by the tee;

three outer edges curvingly extending upwardly from the base section terminating at the respective vertices;

three curved fin like flutes defined by the longitudinal axis of the stem, the outer edges and the fan shaped projections, the flutes spaced equally with respect to the stem, the flutes being identical in size and shape and spiralling upwardly from the base section to the vertices, whereby, the flutes provide stability against the tee becoming twisted, or loosened due to poor soil conditions, wind gusts, or air currents preceding a swinging golf club.

2. The golf tee according to claim 1, wherein the three fan shaped projections define an open space, the open space allowing for wind gusts or air currents from the golf club to slide under and around the golf ball so that the ball will not be prematurely dislodged thereof.

3. The golf tee according to claim 1, wherein the three outer edges of the flutes each define a plurality of notches, the notches making it easier for the golfer to quickly ascertain the correct depth to insert the tee into the ground.

4. The golf tee according to claim 1, wherein the tee is a substantially rigid body made from an extruded plastic material.

5. A golf tee for enabling a golf ball to be hit off the tee without any premature movement imparted to the ball by either the tee or air currents generated by a swinging golf club head, the tee comprising:

a support stem having an upper end and a lower end, a pointed base section at the lower end for inserting the tee into the ground;

a plurality of fan shaped projections spaced in respect to and extending curvingly upwardly from the upper end of the stem and terminating in a plurality of vertices;

the vertices radially equidistant, substantially elevated with respect to the stem, the vertices spaced so that the ball will be supported in a stable, elevated position with absolute minimum point like contact such that premature spin will not be imparted upon the ball; and the plurality of projections defining an opening therein, the opening allowing wind gusts or air currents fron the swinging club head to pass under and around the ball, thereby not allowing the ball to become prematurely dislodged.

6. The golf tee according to claim 5, wherein the tee includes a plurality of fin like flutes spaced equally with respect to the stem, identical in size and shape, spiralling upwardly from the base section and terminating at the respective vertices, the flutes resisting twisting or loosening of the tee from poor soil conditions, wind gusts or air currents from the approaching golf club head.

7. The golf tee according to claim 6, wherein each flute has an outer edge, the outer edge defining a plurality of notches therein, the notches helping a golfer to quickly ascertain the depth in which to embed the tee.

8. The golf tee according to claim 7, wherein the tee is a substantially rigid body made from an extruded plastic material.

9. A golf tee designed to avoid imparting spin to a golf ball, prematurely dislodging the ball or having the tee twist or become loose while embedded in the ground, the tee comprising:

an elongate central support stem having a longitudinal axis, the stem having an upper end and a lower end, a pointed base section integral with the lower end for easy insertion of the tee into the ground;

three fan shaped projections evenly spaced in respect to and curvingly extended upwardly from the upper end of the stem, the projections terminating in three radially equidistant vertices, the vertices substantially elevated with respect to the stem and spaced so that the golf ball may be may be supported in a stable, elevated position with absolute minimum point like contact to avoid imparting spin to the ball;

three fin like flutes spaced equally with respect to the longitudinal axis of the stem, identical in size and shape, the flutes spiralling upwardly from the base section to the vertices, the flutes stabilizing the tee against twisting or loosening due to poor soil conditions, wind gusts or air currents from an approaching golf club head; and the three fan shaped projections defining an opening, the opening allowing the wind gusts and air currents to pass below and around the golf ball without prematurely dislodging it.

10. The golf tee according to claim 1, wherein the flutes have outer edges defining a plurality of notches for allowing the golfer to quickly ascertain, by feel, the depth of the embedded tee.

11. The golf tee according to claim 10, wherein the tee is a substantially rigid body made from extruded plastic material.

* * * * *